US008695831B2

(12) United States Patent
Schick

(10) Patent No.: US 8,695,831 B2
(45) Date of Patent: Apr. 15, 2014

(54) PACKAGING CONTAINER

(75) Inventor: Werner Schick, Neuenkirchen (DE)

(73) Assignee: Poppelmann Holding GmbH & Co. KG, Lohne (DE)

( * ) Notice: Subject to any disclaimer, the term of this patent is extended or adjusted under 35 U.S.C. 154(b) by 24 days.

(21) Appl. No.: 13/467,452

(22) Filed: May 9, 2012

(65) Prior Publication Data

US 2012/0305562 A1 Dec. 6, 2012

(30) Foreign Application Priority Data

May 11, 2011 (DE) ..... 20 2011 100 532 U

(51) Int. Cl.
*B65D 41/32* (2006.01)

(52) U.S. Cl.
USPC ..... 220/266; 220/260; 220/261; 220/269; 220/270; 220/377; 220/606; 220/781; 206/506; 206/507; 206/508; 206/515; 206/519

(58) Field of Classification Search
USPC ..... 220/260, 266, 269, 270, 377, 606, 781; 206/506, 507, 508, 515, 519
See application file for complete search history.

(56) References Cited

U.S. PATENT DOCUMENTS

| | | | | |
|---|---|---|---|---|
| 4,721,210 | A | 1/1988 | Lawrence et al. | |
| 5,236,101 | A * | 8/1993 | Dugmore | 220/265 |
| 8,308,010 | B2 * | 11/2012 | Letica et al. | 220/293 |

FOREIGN PATENT DOCUMENTS

| | | |
|---|---|---|
| DE | 2533631 | 7/1975 |
| DE | 20017211 | 4/2001 |
| DE | 202004000992 | 5/2004 |
| DE | 202004008076 | 11/2005 |
| DE | 20321075 | 6/2006 |

* cited by examiner

*Primary Examiner* — Anthony Stashick
*Assistant Examiner* — Elizabeth Volz
(74) *Attorney, Agent, or Firm* — Husch Blackwell LLP; H. Frederick Rusche; Robert C. Haldiman

(57) ABSTRACT

A package comprises a lid and a container forming a lower contact area, the container having a receiving space bordered by a side wall, an apron extending along an upper region of the side wall, and a tamper-evident closure preferably including a tamper-evident tab which, after filling the packaging container, can be detached by a consumer. The lid is formed as a clamp-on or clip-on lid and can be fixed to the upper container rim, wherein the tamper-evident tab is transparent and the container has an optical indicator for marking the tamper-evident tab.

11 Claims, 5 Drawing Sheets

PACKAGING CONTAINER

CROSS-REFERENCE TO RELATED APPLICATIONS

This application claims priority to German Patent application No. DE 202011100532.5 filed on May 11, 2011.

BACKGROUND

The present invention relates to a packaging container made of plastic for storing food that is preferably suitable for hot filling, in particular a food container made of plastic, comprising a lid and a container forming a lower contact area, said container having a receiving space bordered by a side wall, an apron extending along an upper region of the side wall, and a tamper-evident closure preferably comprising a tamper-evident tab which, after filling the packaging container, is to be detached by a consumer for the first opening, wherein the lid formed as a clamp-on or clip-on lid can be fixed to the upper container rim.

SUMMARY OF THE INVENTION

Products according to the preamble of the claim 1 that are available on the market often have tamper-evident closures and tamper-evident tabs which are difficult to find and to open for senior citizens at the age of, for example, 70 or older.

It is therefore an object of the present invention to configure a subject matter according to the preamble of the claim 1 in a manner better suited for senior citizens.

The object is achieved by a packaging container made of plastic for storing food that is preferably suitable for hot filling, in particular a food container made of plastic, comprising: a lid; a container forming a lower contact area; said container having a receiving space bordered by a side wall; an apron extending along an upper region of the side wall; a tamper-evident closure, said tamper-evident closure being detachable by a consumer, said lid being clamped on an upper container rim; said tamper-evident closure being transparent; said container having an optical indicator for marking said tamper-evident closure; and said indicator being arranged between a longitudinal center axis perpendicular on the lower contact area and a surface of the tamper-evident closure, which surface faces away from said longitudinal center axis. Advantageous configurations of the invention arise from other embodiments in the following description.

According to the invention, it is provided to configure the tamper-evident tab to be transparent and to provide the packaging container with an optical indicator for marking the tamper-evident tab, wherein said indicator is arranged between a longitudinal center axis standing perpendicular on the lower contact area and a surface of the tamper-evident tag, which surface faces away from said longitudinal center axis. The tamper-evident closure is often designed as a tamper-evident tab arranged on the apron by means of predetermined breaking point projections. This tab has to be folded back or torn off to be able to grip the lid's grip tab lying behind there. In order to make the opening experience more comfortable for a senior citizen, the tamper-evident closure or the tamper-evident tab according to the invention is optically marked with an optical indicator, i.e. is better visible to the human eye. In particular, the optical indicator is of a contrasting color with respect to the rest of the packaging container and is preferably colored in a signal color, in particular in red. The transparent tamper-evident tab is designed such that it lets a real image of the indicator be seen through in a manner that it is at least partially visible to the human eye. In particular, with regard to the lower contact area, the optical indicator is arranged at the height of a tamper-evident tab of the tamper-evident closure and is located between said tab and the longitudinal center axis.

The optical indicator can be at least partially formed by means of a partial coloring of the tamper-evident tab, which can be implemented by producing the container as a two-component construction.

Alternatively or additionally, the indicator can be at least partially formed by a portion of the lid that is at least partially located between the tamper-evident tab and the longitudinal center axis. The grip tab which has to be gripped after detaching or opening the tamper-evident tab can be clearly optically distinguished with respect to the rest of the lid and the container by means of contrasting colors and can in particular be visible through the transparent tamper-evident tab of the tamper-evident closure.

Particularly advantageous, the indicator is formed as a label of the packaging container and, during the manufacturing process of the pot, is preferably arranged as an in-mold label directly in the side wall of the pot. Here, without using a two-component tool, a portion of the label that is clearly visible and of a contrasting color can be arranged behind the grip tab and thus can mark the position of the opening means of the packaging container in a manner suitable for senior citizens. It is to be understood that only a portion of the label can be formed as an optical indicator and the rest of the label can be colored differently. However, a label having a single-color, preferably red, background can also represent a clear indication on a front side of the packaging container, even for persons with poor eyesight, and therefore clearly highlights the tamper-evident tab.

As an alternative or in addition to an optical indicator for the tamper-evident tab, the region surrounding the tab can be provided in particular with a visual hint.

Preferably, except for stabilizing webs and without requiring further projections, the side wall of the container is formed to transition directly into an upper rim preferably formed as a sealing rim, wherein in particular in the region of a label or tag, the side wall region covered by the label/tag is formed without ribs or webs. Thus, the label can easily be arranged in the region of a tamper-evident closure and almost over the full surface across the height of the side wall, and no problems occur when filling the webs during an injection molding process.

Advantageously, a packaging container according to the invention is formed in such a manner that the apron and the uppermost portion of the side wall together with the upper rim form a substantially n-shaped profile, wherein the optical indicator can be arranged on a leg of the "n".

Here, the tamper-evident tab can be fixed by means of at least one predetermined breaking point on the apron that forms a portion of the leg of the n-shaped profile.

An indication of the tamper-evident tab of a packaging container according to the invention is further improved if the tab protrudes outwardly, for example in such a manner that in the case of an otherwise circular bucket, said tab protrudes beyond the radius of the remaining apron.

The visibility of the tamper-evident tab is further improved if—as provided in a further configuration of the invention a circumferential upward projecting rim of the lid transitions on its inner side facing away from a grip tab of the lid into an embossment of the lid face, which embossment does not exist in the remaining lid face. The combination of a tamper-evident tab indicator generated by means of the shape of the lid and visible in a pure top view, optionally supported or replaced by a corresponding indication in the label of the lid face, with a color-marked tamper-evident tab results in a particularly good visibility of the same. Moreover, it is advantageous to laterally border the tamper-evident tab by rim lugs which point upward from the apron and increase the region around the tamper-evident tab.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further advantages and details of the invention arise from the following description of the figures.

In the figures, schematically.

DETAILED DESCRIPTION

Parts with identical or similar function are designated—if useful—with identical reference numbers. Individual technical features of the exemplary embodiments described below in combination with the above-described exemplary embodiments may also result in inventive refinements.

Figure 1:
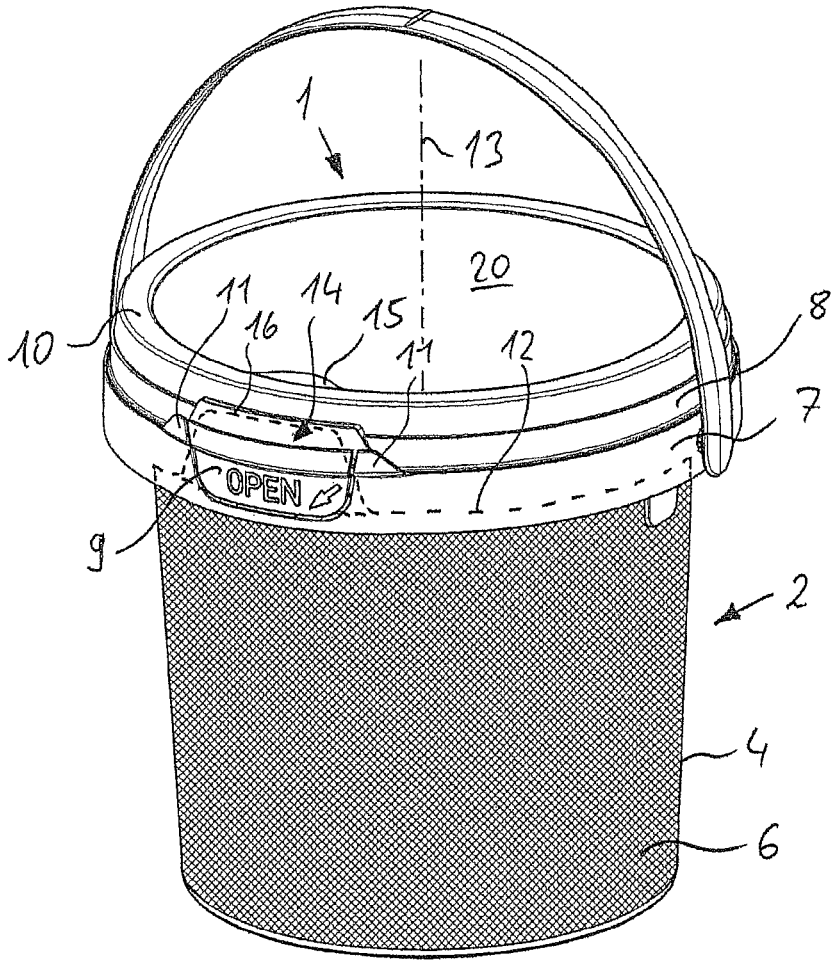
FIG. 1 shows a perspective view of an object according to the invention.
Figure 3:
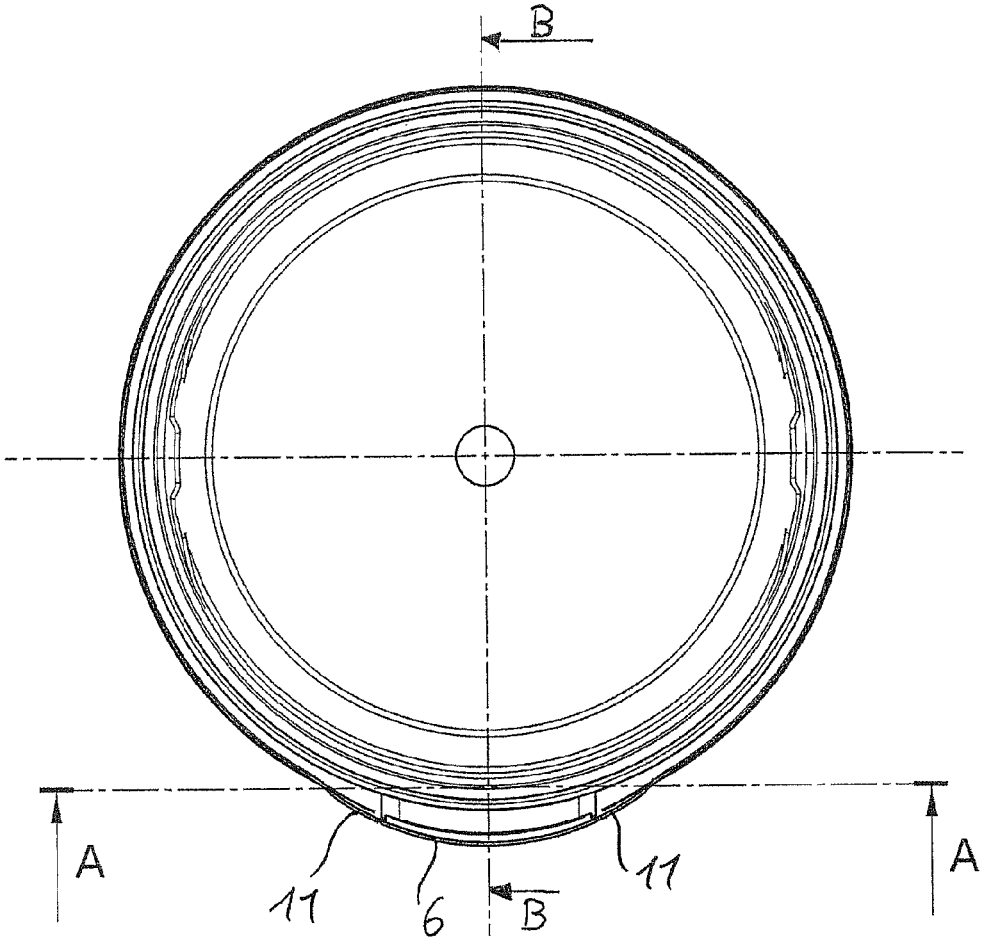
FIG. 3 shows a top view on the object according to FIG. 2.
Figure 4:
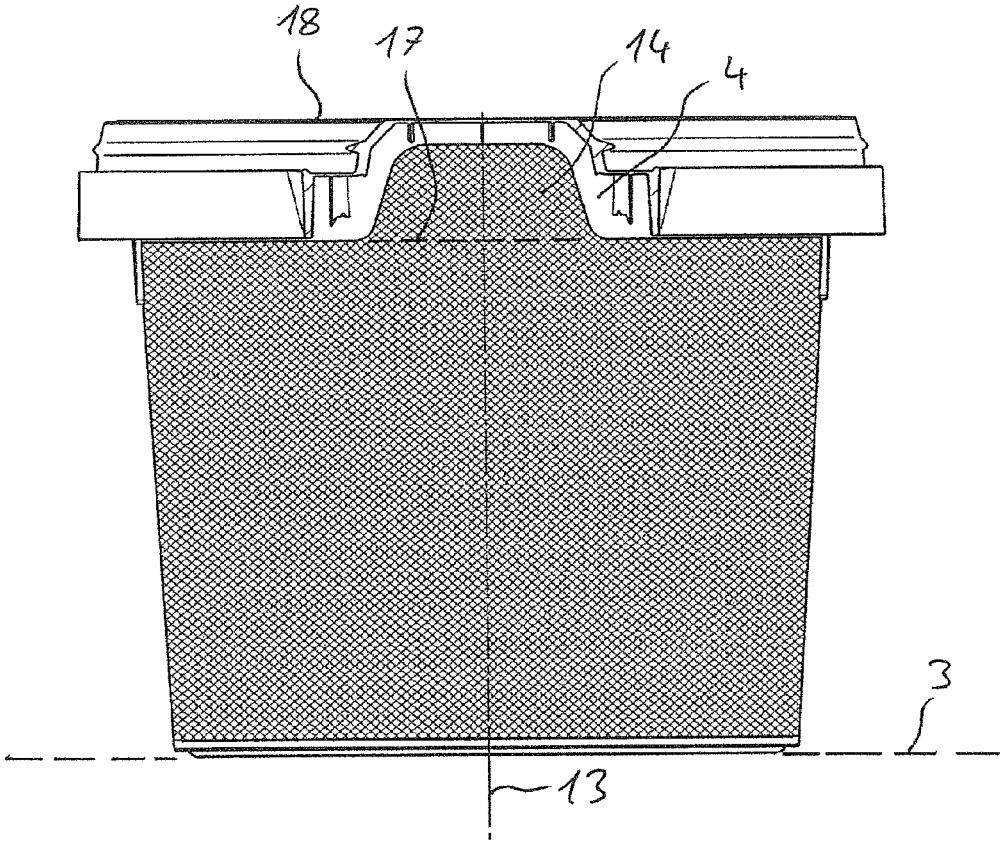
FIG. 4 shows the section A-A according to FIG. 3.

An inventive packaging container according to FIG. 1 is formed as a food container made of plastic and comprises a lid 1 and a container 2 which forms a lower contact area 3 (cf. FIG. 4). In the view of FIG. 1, a side wall 4 is provided with a label 6 covering the entire surface. The side wall 4 borders a receiving space substantially located below the lid 1. In the upper region of the side wall 4, the container has an apron 7, the upper portion of which is covered by an outer rim 8 of the lid. A tamper-evident closure comprising a tamper-evident tab 9 is arranged on the apron and protrudes slightly beyond the outer rim of the apron (cf. FIG. 3). Rim lugs 11 serve, on the one hand, as protection against unintended opening and, on the other, as additional visualization of a tamper-evident closure comprising the tamper-evident tab 9. A dashed line 12 indicates an upper edge of a portion of the label 6. In the region of the tamper-evident tab 9, between said tab and a longitudinal center axis 13 perpendicular to the lower contact area 3, and the transparent tamper-evident tab 9, an optical indicator 14 is arranged which is indicated by a dashed line 16 and is formed as a portion of the label 6. Thus, the indicator is arranged between the tab's 9 surface facing away from the longitudinal center axis 13 and bearing the lettering "OPEN" and the longitudinal center axis 13. Instead of using a label, the indicator 14 can also develop indicator properties through the structure of the surface of the side wall or the apron located behind the tamper-evident tab 9.

The lid 1, which forms a circumferential upward projecting rim 10, transitions on its inner rim 10 side facing away from a non-illustrated grip tab of the lid 1 into an embossment 15 of the lid face 20.

Figure 2:
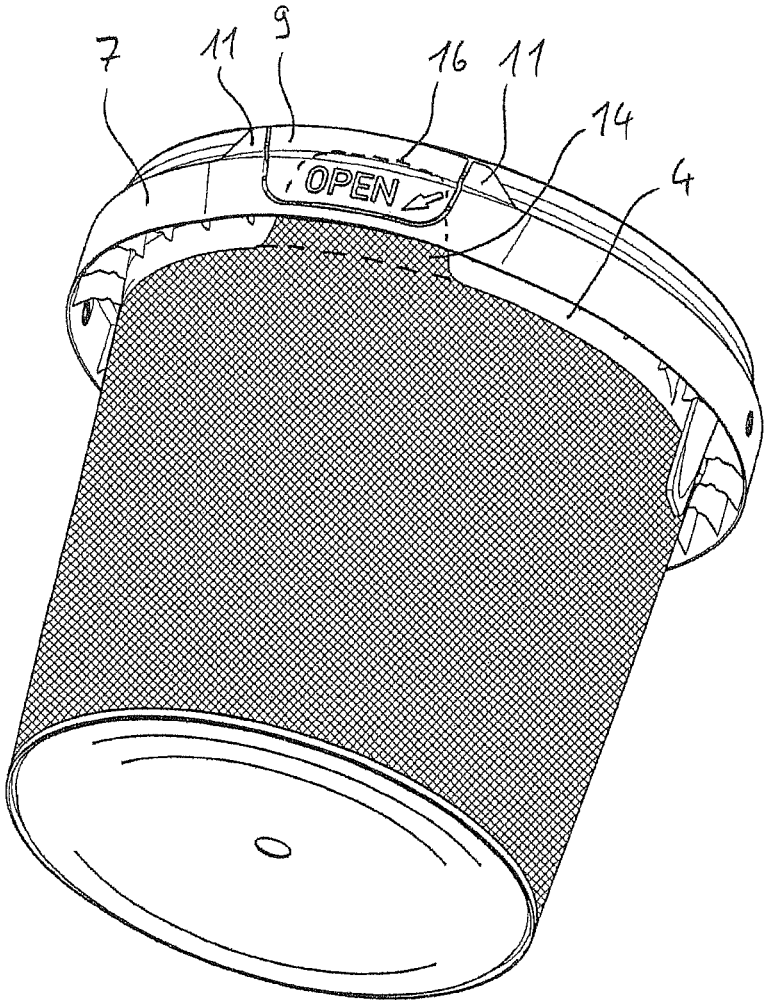
FIG. 2 shows a portion of the object according to FIG. 1 in a further perspective view.

The view of FIG. 2 shows that the indicator is formed in one piece with the label 6 and is arranged in a rib-free region of the side wall 4. This is in particular advantageous for in-mold labels because otherwise the arrangements of the in-mold label between apron 7 and side wall 4 would be affected, or a label to be placed on the outside of the sidewall could not be brought far enough behind the tamper-evident tab 9. At the same time, when using an in-mold label, forming the ribs using the injection molding process could be obstructed.

While the exemplary embodiments are substantially used for injection-molded products, it is also possible to produce a packaging container according to the invention by deep-drawing.

Figure 5:
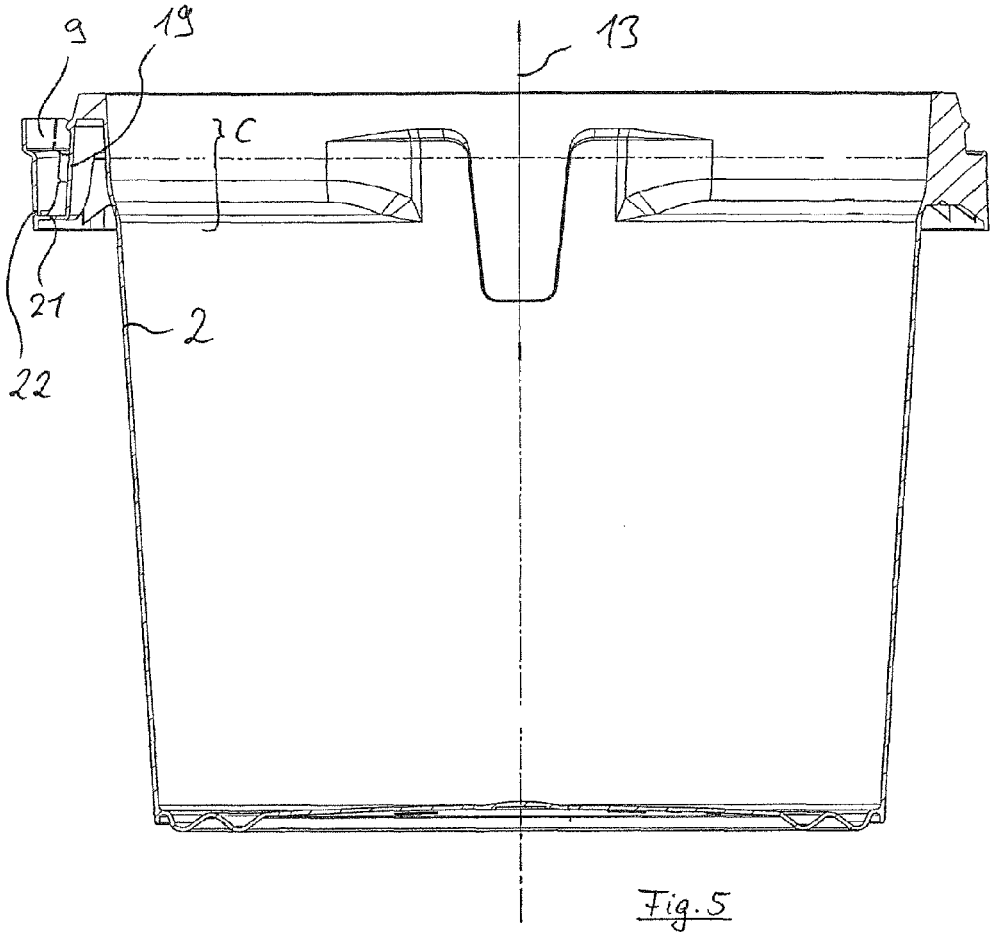
FIG. 5 shows the object according to FIG. 3 along the section B-B.

According to FIG. 4, the in-mold label with the optical indicator 14, which is defined by means of a line 17 with respect to the rest of the label, extends to just below the sealing rim 18 of the container according to the invention. By dispensing with further projections extending in the horizontal direction, a label can be formed without any problem as an in-mold label. Also, in the other side wall regions of the wall 4, except for the sealing rim 18, no horizontal projections are arranged. On the left upper side of the packaging container according to FIG. 5, this region C of the side wall 4 (cf. FIG. 5), in which the label formed as an in-mold label is incorporated, forms the right leg of an approximately n-shaped profile of the upper packaging container. A left leg 19 formed by the apron 7 has in its lower region a projection 21 to which the tamper-evident tab 9 is attached by means of predetermined breaking points 22.

The optical indicator is substantially arranged across the height of the tamper-evident tab 9 in the region C between the longitudinal center axis 13 and the tamper-evident tab 9; however, it could also be arranged in the leg 19. However, for process-related reasons, the arrangement on the inner side wall 4 is advantageous for an injection molding method because in this case filling the mold cavity is affected to the least possible extent.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

The invention claimed is:

1. A packaging container made of plastic for storing food that is preferably suitable for hot filling, in particular a food container made of plastic, comprising:

a lid;

a container forming a lower contact area;

said container having a receiving space bordered by a side wall;

an apron extending along an upper region of the side wall;

a tamper-evident closure, said tamper-evident closure being detachable by a consumer, said lid being clamped on an upper container rim;

said tamper-evident closure being transparent;

said container having an optical indicator for marking said tamper-evident closure; and said indicator being arranged between a longitudinal center axis perpendicular on the lower contact area and the tamper-evident closure.

2. The packaging container according to claim 1 wherein said tamper-evident closure is a tab.

3. The packaging container according to claim 1, wherein the indicator is at least partially formed by a lid portion located at least partially between a tamper-evident tab and the longitudinal center axis.

4. The packaging container according to claim 1, wherein a tamper-evident tab protrudes outwardly.

5. The packaging container according to claim 1, wherein a circumferential upward projecting rim of the lid transitions on its inner side facing away from a grip tab of the lid into an embossment of a lid face.

6. The packaging container according to claim 1, wherein the tamper-evident tab is laterally bordered by two rim lugs which point upward from the apron and which increase the region around the tamper-evident tab.

7. The packaging container according to claim 1, wherein the indicator is formed by a label of the packaging container.

8. The packaging container according to claim 7, wherein the label is formed as in-mold label.

9. The packaging container according to claim 1, wherein the side wall at least partially transitions directly into an upper rim, said upper rim being a sealing rim.

10. The packaging container according to claim 9, wherein the apron and an uppermost portion of the side wall form with the upper rim a substantially n-shaped profile.

11. The packaging container according to claim 9, wherein a tamper-evident tab is fixed to the apron with at least one predetermined breaking point.

* * * * *